United States Patent [19]

Ruffner et al.

[11] 4,170,054

[45] Oct. 9, 1979

[54] CASKET

[76] Inventors: Arno Ruffner, Haldenstrasse 33, CH-2555 Bruegg; Roland Siegfried, Promenade de la Suze, CH-2502 Biel-Bienne, both of Switzerland

[21] Appl. No.: 822,570

[22] Filed: Aug. 8, 1977

[51] Int. Cl.[2] ..... A61G 17/00

[52] U.S. Cl. ..... 27/4

[58] Field of Search ..... 27/2, 3, 4; 229/16 R, 229/23 R

[56] References Cited

U.S. PATENT DOCUMENTS 3,729,786 5/1973 Walding ..... 27/3

FOREIGN PATENT DOCUMENTS 357701 8/1922 Fed. Rep. of Germany ..... 27/3

695407 1/1941 Fed. Rep. of Germany ..... 27/3

1388540 3/1975 United Kingdom ..... 27/4

*Primary Examiner*—John D. Yasko

*Attorney, Agent, or Firm*—Bierman & Bierman

[57] ABSTRACT

A casket comprising a perimeter frame and a cardboard box-like member and a closure member. The box member and closure member are attached to the perimeter frame which is made of a rigid material. The entire casket can be shipped flat. The cardboard box member is provided with a plurality of fold breaks, thus allowing the user to fold the box member to its final shape for attachment to the perimeter frame to complete the casket.

8 Claims, 5 Drawing Figures

CASKET

This invention relates to improvements in caskets and in particular relates to a casket which can be assembled by the mortician or funeral home.

Todays caskets are generally made of wood or metal and are rather expensive to make. Because of the weight and volume required to ship a casket, it becomes uneconomical to employ central manufacturing facilities and to then ship the assembled caskets to far away end users. In addition, the wood or metal of which conventional caskets are made is lost to mankind either through incineration or burial, thus denying mankind the use of these materials in other areas, such as in the construction industry.

Properly made caskets must be rigid and appear solid to the family of the bereaved. Additionally, the caskets must be capable of incineration or capable of disintegration if the casket is buried. Although conventional wood caskets fulfill these requirements, they are expensive to manufacture and help to increase the cost of funerals beyond reasonable levels for many families.

In accordance with the present invention, the casket material is made principally of stiff cardboard. Stiffness is provided directly by the cardboard, especially if a corrugated cardboard material is used, tri-wall cardboard material being preferred. The cardboard is folded into a box-like shape and secured to a rigid perimeter frame which may be made of wood, plastic, or other incineratable or disintegratable material.

Advantageously, the cardboard box-like member may be prefolded or have a plurality of fold breaks so that the cardboard member can be shipped flat, thus reducing shipping cost to distant points. The cardboard member is then reassembled by the end user upon demand.

By employing cardboard members for caskets, central manufacturing facilities can be employed to obtain the benefits of large scale manufacturing, especially since shipping costs will be low in comparison to conventional wood or metal caskets.

In a preferred form of the invention, two box-like cardboard members are provided with flanges along sections of their perimeter. A plurality of wood perimeter frame is used to clamp the flanges between them, final assembly occurring through the medium of fastening means which fasten the perimeter frames to each other.

Referring now to the drawings in which like numerals refer to like parts:

Figure 1:
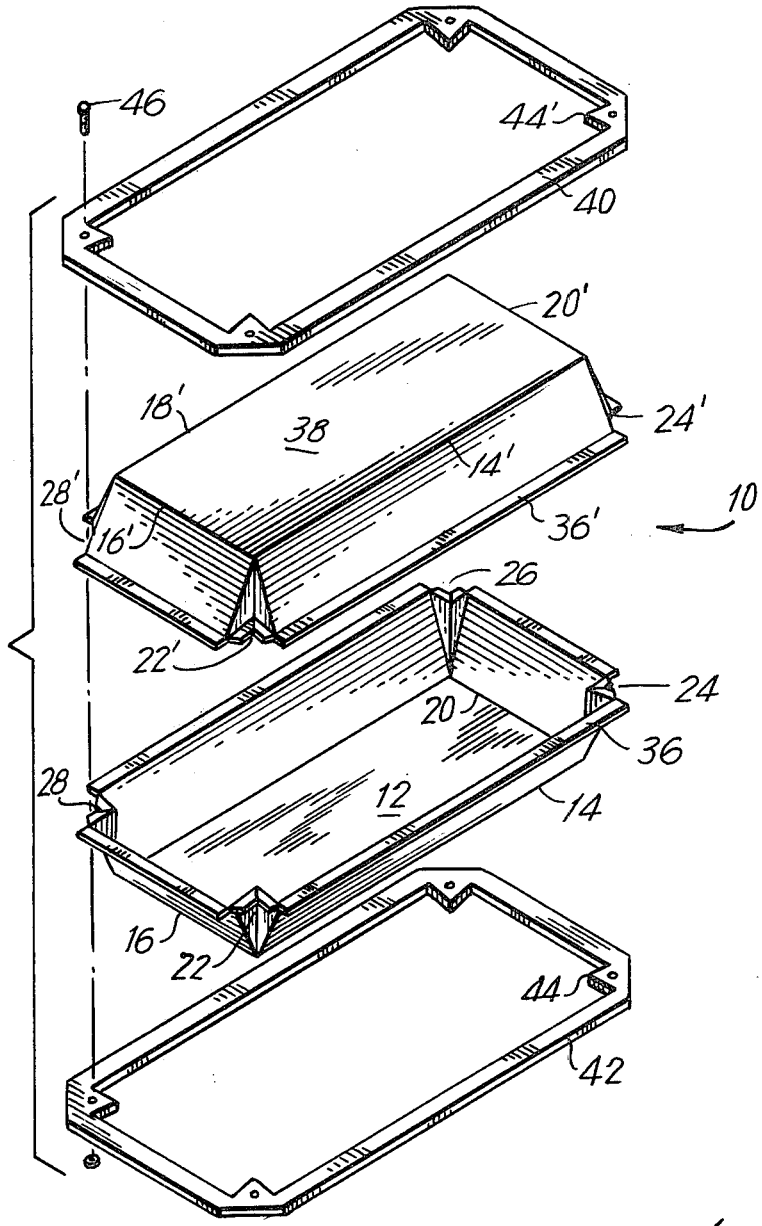
FIG. 1 is an exploded view of the completed casket.
Figure 2:
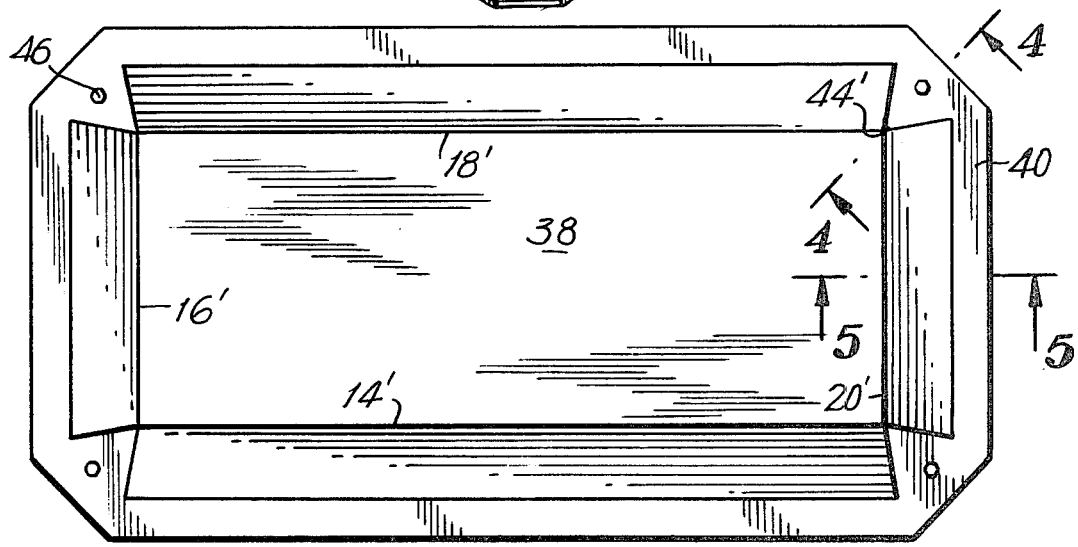
FIG. 2 is a plan view of the box-like member with the stiffening member in place.

Referring now to the drawings, the numeral 10 refers to the casket assembly. The casket comprises a box-like member 12 made of corrugated cardboard, preferably of tri-wall construction. The tri-wall construction of the cardboard member is shown in detail in FIGS. 4 and 5.

The box-like member is folded along lines 14 through 20 to form a rectangularly shaped box-type structure. Additionally, the four corners denoted by the numerals

22 through 28 each comprise a plurality of fold lines denoted by the numerals 30, 32 and 34, all of which radially eminate from a selected point. When folded, the corners are reentrant with corner fold line 32 being located inwardly of the outer perimeter of the box-like member.

The box-like member is provided with a flange 36 along substantially the entire perimeter.

Upper or closure member 38, as shown in the drawings, is of the same material. The closure member 38 is shown as having the same shape as box-like member 12. However, it is to be understood that the closure member can be any shape and need not be complimentary in shape to the box-like member 12. Since the closure member depicted is the same in shape as the box-like member, the same numerals have been used to denote the various sections of the closure member 38.

Figure 5:
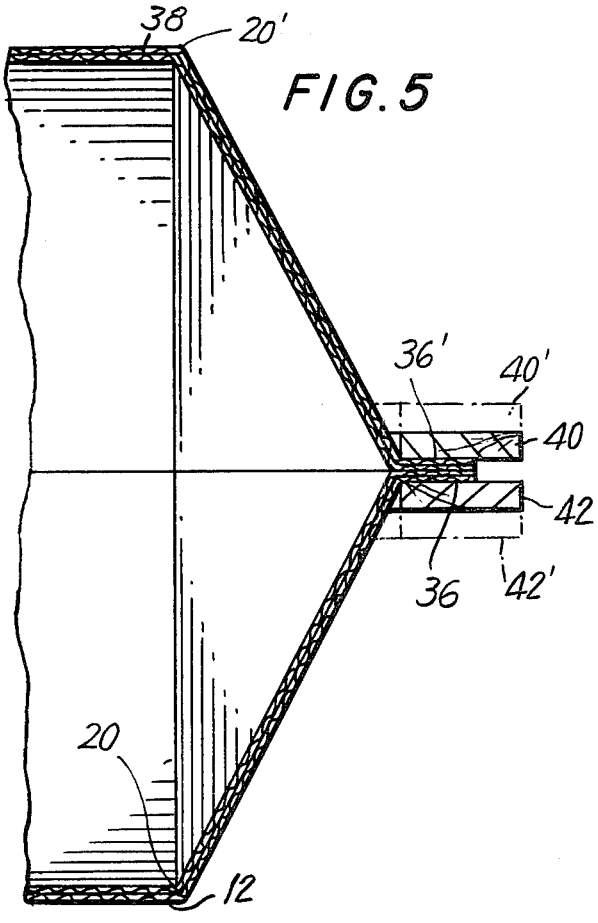
FIG. 5 is a sectional view taken along line 5—5 of FIG. 2.

The entire box-like structure is bound together by two perimeter frames denoted by the numerals 40 and 42. If desired, a plurality of perimeter frames may be used to add extra stiffness or for appearance sake. FIG. 5 indicates, in dotted lines, the use of two additional perimeter frames. The perimeter frames each have at their corners inwardly projecting members denoted by the numerals 44 and 44' which engage the reentrant corners on the box-like member 12 and the closure member 38. The perimeter frames add considerable stiffness to the assembly allowing the cardboard sections to be used as casket material.

The perimeter frames are preferably made of wood although it is to be understood they can be made of any material capable of being burned or capable of disintegration after burial.

Figure 4:
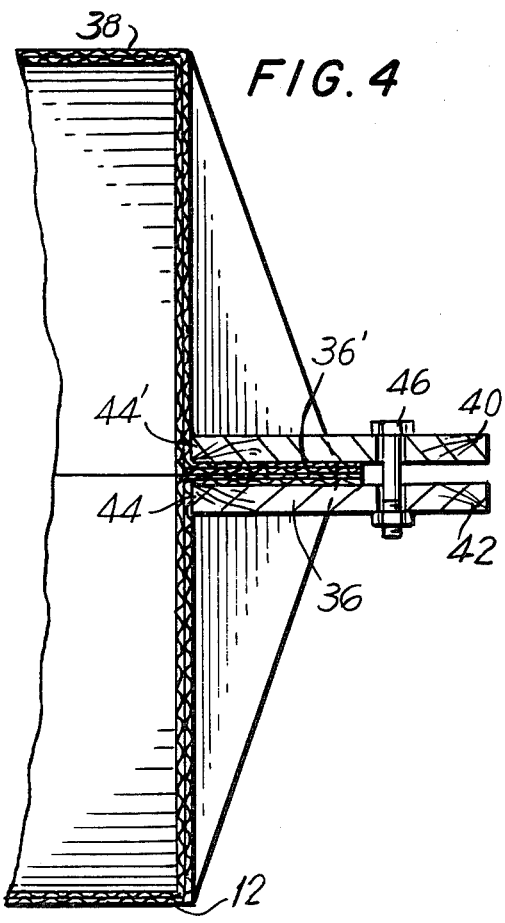
FIG. 4 is a sectional view taken along line 4—4 of FIG. 2.

Assembly is completed by slipping the flanges of the two cardboard members between the perimeter frames and then fastening the perimeter frames together with conventional fasteners such as the screws denoted by numeral 46 (see FIG. 4). It is to be understood that the final assembly of the casket is not completed until the body of the person to be interred or incinerated has been placed in the casket.

Figure 3:
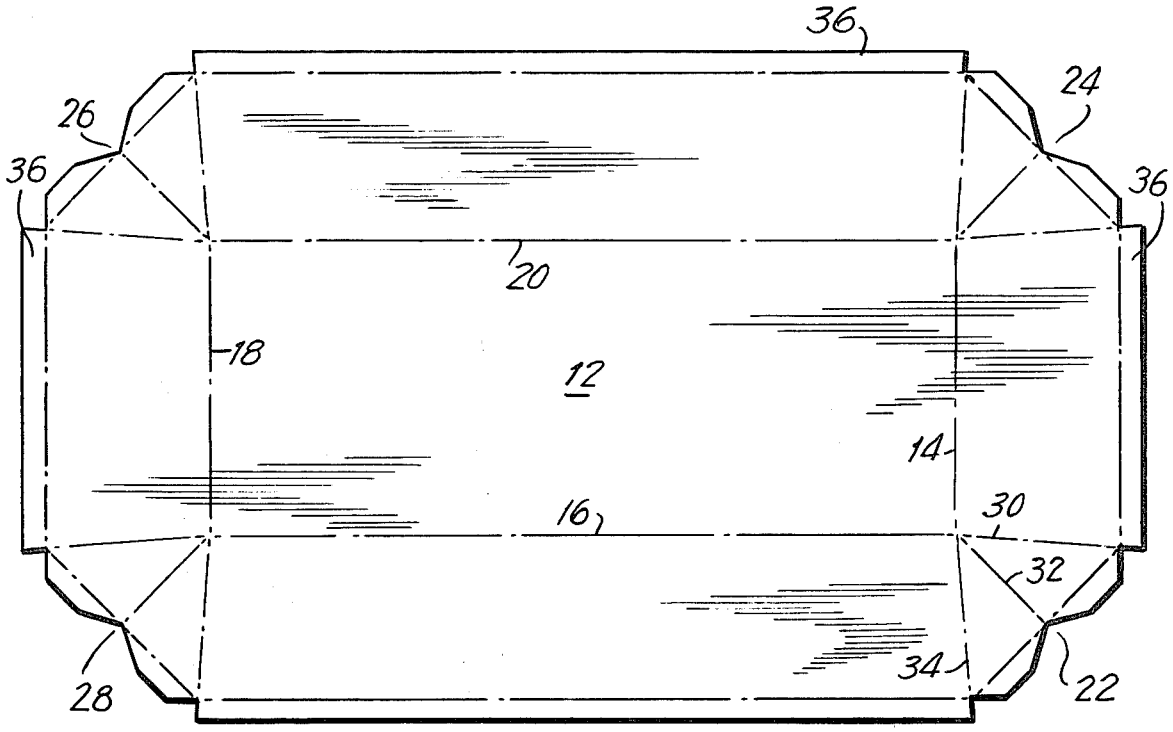
FIG. 3 is a plan view of the box-like member prior to folding.

Referring to FIG. 3, the box-like member 12 is shown folded flat. In manufacture, sheets of cardboard are cut to shape and then conventional folding machines are used to prebreak the cardboard along selected lines. For the cardboard shape shown in FIG. 1, the fold break lines for the flat section of cardboard are as shown.

Embellishments such as coatings of various types, including paint, may be applied as desired to enhance the visual attractiveness of the completed casket. Embossing may also be employed as may any other method for applying designs to the casket.

It can be readily appreciated that the two cardboard members and the perimeter frames can be made and shipped in flat form. The weight of the cardboard members is low in comparison to conventional wood sections. Additionally, the volume occupied by the casket of the present invention in its flat form is substantially less as compared to conventional preassembled caskets. Accordingly, shipping costs for applicant's casket materials in flat, kit form will be substantially below shipping costs for comparable prefabricated wooden caskets. The present invention permits the casket sections to be manufactured in one location in large quantity for distribution to distant points on an economical basis. Also, lower manufacturing costs should translate into lower cost funerals, bringing decent burial within the means of those traditionally unable to satisfactorily bury departed family members.

Many modifications in and to the embodiment chosen for purposes of illustration may be made by those skilled in the art. It is intended to cover all such modifications and changes which do not depart from the spirit and scope of the invention as defined in the claims appended hereto.

We claim:

1. A casket comprising an open box member folded and shaped to carry a body, a closure member for closing said box member, a rigid perimeter frame for holding together said box member and said closure member, said box member comprising a rectangularly shaped box having four corners, each of said corners being folded inwardly to form a reentrant section, said perimeter frame having four inwardly directed projections, each of which is shaped to fit a corresponding reentrant section on said box member to provide additional stiffness for the casket.

2. The casket according to claim 1 wherein said closure member comprises a rectangular shaped box having four corners each of which is folded inwardly to form four reentrant sections, said perimeter frame inwardly directed projections also fitting into the reentrant sections on said closure member.

3. The casket according to claim 1 wherein the shape of said closure member is substantially the same as the shape of the box member.

4. The casket according to claim 1 wherein the perimeter frame is made of wood.

5. The casket according to claim 3 wherein the box member and closure members are made of tri-wall corrugated cardboard.

6. The casket according to claim 3 further comprising two pairs of perimeter frame members, one pair for use for the said box and one pair for use with said closure member, and means for clamping together the edges of said box member and closure member between the two pairs of perimeter frames.

7. A casket kit comprising a rigid perimeter frame, a first cardboard sheet prefolded to form a flange along selected edge portions of said first sheet, said first sheet further comprising a plurality of fold breaks to permit subsequently folding said sheet into a box structure, the corners of said cardboard sheet having a plurality of radially extending fold breaks to form reentrant corners upon folding said first sheet, a second sheet for use as a closure member for said box member, said second sheet being prefolded to form a flange along selected portions of the edge of said closure member, and means for securing the closure and box members to said perimeter frame.

8. The casket kit according to claim 7 further comprising a second perimeter frame and wherein said second sheet comprises a plurality of fold breaks to permit subsequently folding said second sheet into a box structure, the corners of said second sheet having a plurality of radially extending fold breaks to form reentrant corners upon folding said second sheet.

* * * * *